US005613847A

United States Patent [19]

Lingl

[11] Patent Number: 5,613,847

[45] Date of Patent: Mar. 25, 1997

[54] HEAT TRANSFER IN A TUNNEL KILN

[75] Inventor: Hans Lingl, Neu-Ulm, Germany

[73] Assignee: Hans Lingl Anlagenbau und Verfahrenstechnik GmbH & Co.

[21] Appl. No.: 491,343

[22] Filed: Jun. 30, 1995

[30] Foreign Application Priority Data

Jul. 1, 1994 [DE] Germany ..... 44 23 221.7

[51] Int. Cl.[6] ..... F27B 9/00; F27D 7/00

[52] U.S. Cl. ..... 432/133; 432/25

[58] Field of Search ..... 432/133–138, 432/25, 176, 152

[56] References Cited

U.S. PATENT DOCUMENTS

| | | | |
|---|---|---|---|
| 3,887,326 | 6/1975 | Townley | 432/25 |
| 4,047,886 | 9/1977 | Heyraud | 432/131 |
| 4,249,895 | 2/1981 | Mantegani | 432/133 |
| 4,718,847 | 1/1988 | Manson | 432/137 |
| 4,744,750 | 5/1988 | Lingl, Jr. | 432/137 |
| 4,778,384 | 10/1988 | Lingl, Jr. | 432/137 |
| 4,884,969 | 12/1989 | Kolln et al. | 432/133 |

FOREIGN PATENT DOCUMENTS

| | | |
|---|---|---|
| 0348603 | 1/1990 | European Pat. Off. . |
| 2643406 | 4/1978 | Germany . |
| 3934705.2 | 4/1991 | Germany . |
| 4014505.0 | 11/1991 | Germany . |
| 457729 | 6/1968 | Switzerland . |

OTHER PUBLICATIONS

"Annual for the Brick and Tile Industry," 1992, pp. 91, 92, 94.

"Application of Pulse Combustion in Solid and Hazardous Waste Incineration," Stewart et al.; 1991.

"Cello Hi–Efficiency Burners" brochure, Sonentech, Inc., Atlanta, Georgia, 1992.

*Primary Examiner*—Thomas N. Moulis

*Attorney, Agent, or Firm*—Nixon & Vanderhye

[57] ABSTRACT

In a tunnel kiln for the firing of ceramic products in a tunnel kiln having a preheating zone, a firing zone and a cooling zone, pulse-modulated gas flows from a ventilation unit in the cooling zone to a suction unit in the preheating zone. As a result, the convection heat transmission to the firing ware is increased, particularly in the preheating zone and the cooling zone, thus achieving a more even heat transmission over the entire length of the kiln.

11 Claims, 3 Drawing Sheets

HEAT TRANSFER IN A TUNNEL KILN

TECHNICAL FIELD

The present invention relates to a process for firing ceramic or similar products in a tunnel-type kiln wherein heat transfer to the products is substantially uniform throughout the entire length of the kiln. The present invention also relates to a tunnel kiln for effectuating this purpose.

BACKGROUND

Tunnel kilns, especially in the ceramic industry, are typically divided into three zones: preheating, firing and cooling zones. The firing ware passes through these zones on kiln cars or is otherwise suitably conveyed through the kiln in succession. A gas flow is provided in a direction opposite to the direction of movement of the firing ware through the kiln. The gas flow is generated by means of ventilation units in the cooling zone and suction units in the preheating zone. This gas flow ensures that the heat generated in the intermediate firing zone by burners continually warms the firing ware in the preheating zone and the cold air introduced at the end of the cooling zone continually cools down the fired ware.

The heat transfer (heat transmission) to the firing ware occurs during both preheating and cooling essentially through the two mechanisms of radiant heat transfer and forced convection by means of the flow generated in the tunnel kiln. The entire heat transfer to the firing ware in the preheating zone A, the firing zone B, which is fitted with gas burners or other types of heaters, and the cooling zone C in a typical kiln is represented in FIG. 1A and the respective share of the heat transfer by radiation or heat transmission by convection is shown in FIG. 1B. It can be recognized that the entire heat transmission is greatest in the area of the firing zone B and that the share of heat transfer by radiation is significantly preponderant. In order to increase the speed of the firing ware through the tunnel kiln, it is therefore necessary to increase the heat transmission in the preheating zone and the cooling zone and thus obtain an even heat transmission over the entire length of the tunnel kiln.

It is known to provide air recirculation devices installed separately in the preheating zone (Annual for the Brick and Tile Industry 1992, Page 92) or in the cooling zone (European Patent Application No. 0 348 603 A3), in order to increase the heat transmission on the basis of a forced convection. However, a disadvantage here is that the heat transmission is dependent on the direction of the stream from the additional injection units. Thus there are zones with high heat transmission in the immediate vicinity of the air stream of the injection unit and zones with lower heat transmission in those parts of the firing setting which are not reached by the stream. Furthermore the necessary requirement of units effecting the circulation is relatively high.

A further measure to increase the forced convection is the use of high-velocity burners with high pulse flows (Annual for the Brick and Tile Industry 1992, Page 94). As a result, however, the convection is increased particularly in the firing zone, instead of in the preheating and cooling zone.

A further method of increasing the heat transmission in the kiln is the use of impulse burners, which are known for example from waste incinerating plants (Chip R. Stewart et al., "Application of Pulse Combustion to Solid and Hazardous Waste Incineration", 1991; Brenchly, D. L., et al, Battelle Report PNL-5301/UC-95, December 1984; Brochure Cello Hi-Efficiency Burners, Atlanta 1992). Impulse burners are suitable for setting the kiln gases in the firing zone area into vibration. In a furnace with a large firing area filled with mainly liquid, powdery or gaseous firing ware, for example in a waste incinerating plant, this method is very effective. However, it is not effective in a tunnel kiln, where the firing channel is virtually filled over the entire length with firing ware which acts as a filter dampening the pressure vibrations. Furthermore in tunnel kilns, especially in the ceramic industry and unlike waste incinerating plants or cement pipe kilns, a large number of burners with relatively small capacity are in operation, coordinated in groups. Pulsation is only then effective when at least an entire burner block works in pulsed operation.

Another disadvantage in the use of pulsating burners in tunnel kilns lies also in the fact that the pulsation is not continued sufficiently into the preheating and cooling zones because of the dampening effect of the firing setting. The increase in heat transmission, therefore, does not take place where it is most needed.

DISCLOSURE OF THE INVENTION

In accordance with the present invention, there is provided a process and an installation in which the transmission to products within a tunnel kiln takes place more evenly over the entire length of the tunnel kiln. Generally, the present invention provides for the firing of ceramic products or like products wherein the products pass in succession through a preheating zone, a firing zone having burners and a cooling zone in a tunnel kiln and in which gas flows countercurrently with respect to the direction of movement of the products through the tunnel kiln. The gas flow through the tunnel kiln is pulse-modulated, at least in the preheating and cooling zones and preferably in all three zones. Thus, an increase in the heat transfer to the products is achieved, at least in the preheating and cooling zones, by means of an increase in the forced convection.

In order to generate a pulse-modulated gas flow in the area of the cooling zone, the tunnel kiln according to invention has at least one ventilation unit, the capacity of which can be pulse-modulated. Depending on the length of the tunnel kiln and the dampening caused by the products to be fired in the kiln and on the kiln cars, it is also advantageous in the preheating zone to provide a suction unit, the capacity of which can likewise be pulse-modulated.

An advantage of the present invention lies in the fact that the heat transmission takes place more evenly over the entire tunnel kiln and therefore the kiln throughput can be increased. A further advantage of the present invention lies in the increase in speed in which the kiln gases flowing past the products affords a more even velocity distribution across the cross-section of the kiln.

Further embodiments of the invention relate to a firing process and a tunnel kiln, in which the kiln gases in the tunnel kiln are stimulated with such a frequency that they are set into self-vibration. This can be a vibration both along the tunnel kiln and across the tunnel kiln.

In accordance with further embodiments of the tunnel kiln according to invention, the gas flow can be modulated by a modification of the flow cross-section of the ventilation unit, of the suction unit or of the tunnel kiln itself. This can be provided, for example, by a butterfly valve or other means which periodically restricts the cross-section of the blowing or suction unit.

Still further embodiments of the tunnel kiln according to invention employ burners which can be operated in pulse modulation in the overall combination of a pulsed ventilation unit or a pulsed suction unit.

In a preferred embodiment of the present invention, there is provided a method for firing products in a kiln comprising the steps of passing the firing ware in succession through a preheating zone, a firing zone having burners and a cooling zone in the kiln, flowing gas in a direction opposite to the direction of passage of the firing ware through the kiln from the cooling zone to the preheating zone and pulse-modulating the flow of gas at least in the area of the preheating zone or in the area of the cooling zone.

In a further preferred embodiment according to the present invention, there is provided a tunnel kiln for firing ware comprising a preheating zone, a firing zone having burners and a cooling zone, at least one ventilation unit for the cooling zone and at least one suction unit for the preheating zone for maintaining a gas flow in the kiln in a direction opposite to the direction of the passage of the firing ware through the kiln, and a pulse-modulating unit forming part of at least one of the ventilation unit and the suction unit for pulsing the flow of gas.

Accordingly, it is a primary object of the present invention to provide a novel and improved tunnel kiln and a process for operating the tunnel kiln affording a more uniform distribution of heat transfer within the kiln to the firing products throughout the length of the kiln and particularly in the preheating and cooling zones of the kiln.

BEST MODE FOR CARRYING OUT THE INVENTION

Figure 2:
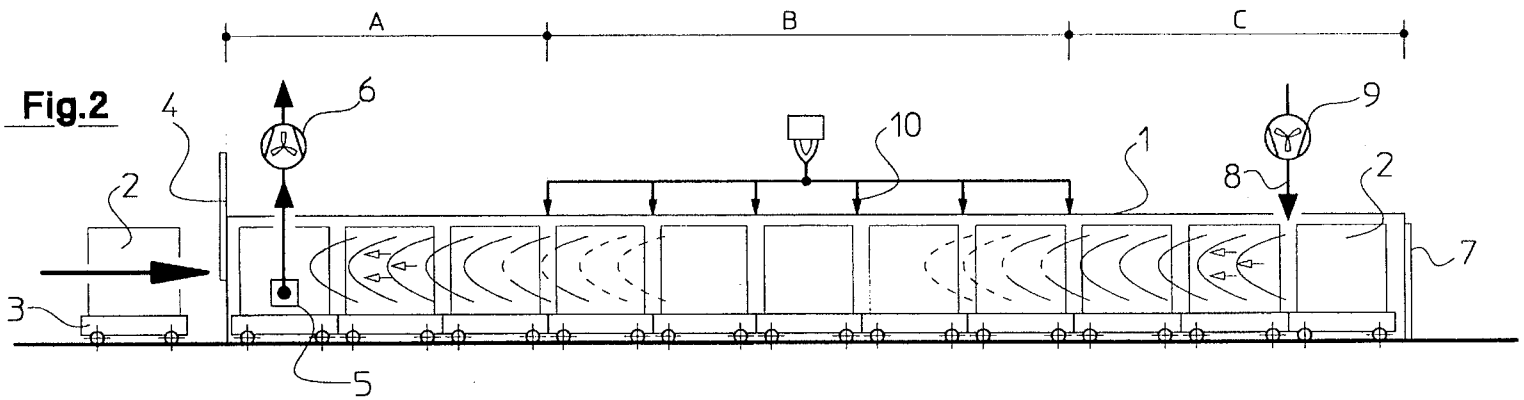
FIG. 2 is a schematic longitudinal cross-sectional view through a tunnel kiln according to a preferred embodiment of the present invention.

A tunnel kiln 1 according to the present invention is represented in FIG. 2 in longitudinal section. Firing ware 2 is moved along kiln 1, for example, on a car 3 in the direction of the arrow. The firing ware passes through a door 4 on the entrance side of kiln 1 first into a preheating zone A, then into a firing zone B fitted with burners 10, and finally into a cooling zone C. A ventilation unit 9 is located in the area of the cooling zone C. A suction unit 6 is located in the area of the preheating zone A. Consequently, a gas flow indicated by the six small arrows is generated in an opposite direction to the direction of movement of the firing ware through the kiln 1. The firing ware is warmed, i.e., is preheated, in zone A by the warmed firing gases, reaches its maximum temperature in the firing zone B, mainly because of the radiant heat transmission from the burners 10 positioned in the kiln ceiling and the side walls, and is cooled down in the cooling zone C by counterflowing ambient air directed into the kiln 1 by ventilation unit 9.

Figure 3:
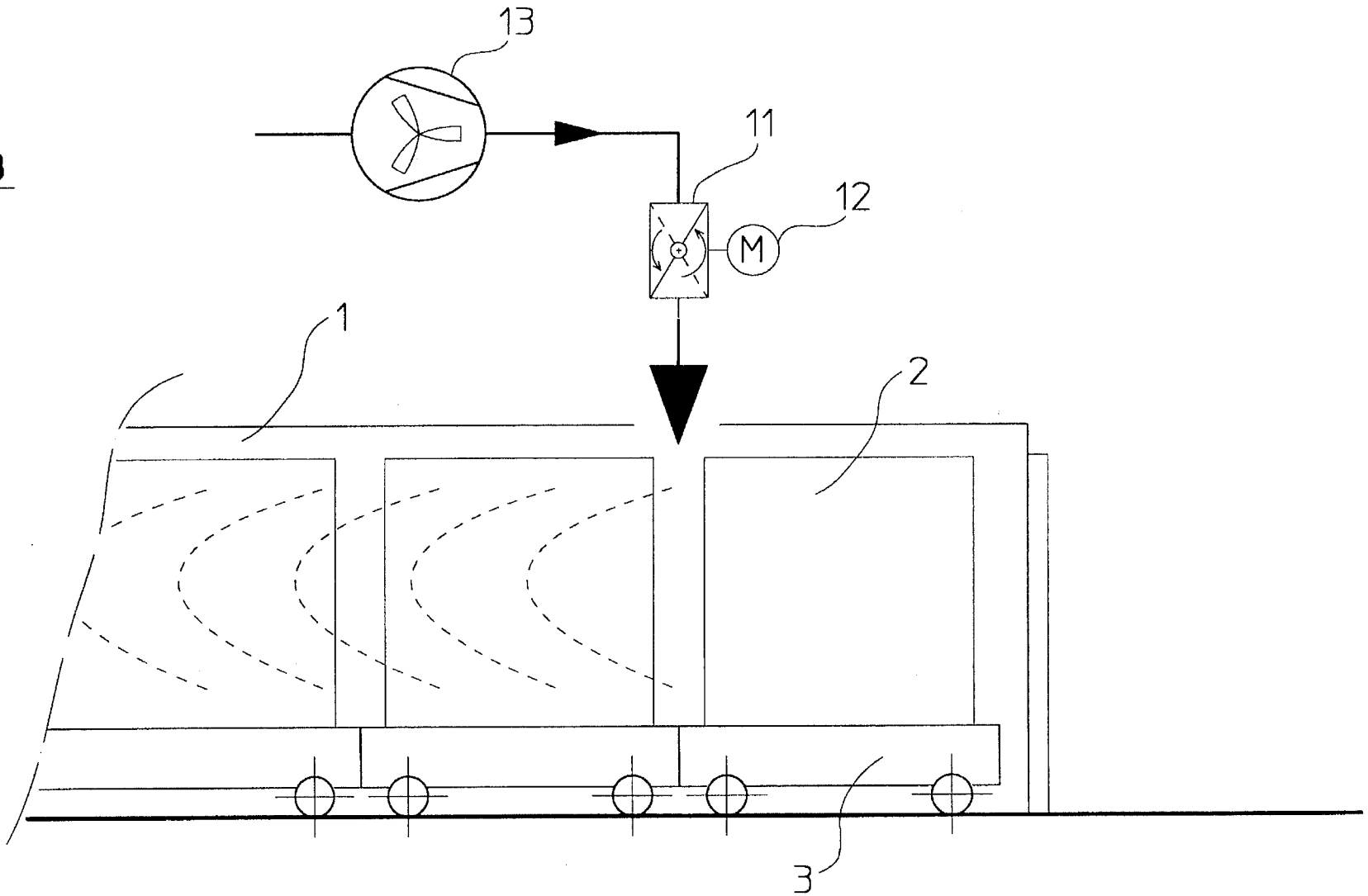
FIG. 3 is a fragmentary enlarged longitudinal cross-sectional view of the cooling zone of the tunnel kiln of FIG. 2.

In accordance with the present invention, the ventilation unit 9 and/or the suction unit 6 can be operated in a pulse modulation mode. To accomplish this and as represented in FIG. 3, the output of a fan 13 is modulated by a butterfly valve 11 with a speed-controlled drive 12. Thus, bursts or pulses of air are introduced into kiln 1 in response to the controlled oscillatory movement of the butterfly valve. The pulses of air are represented in FIG. 3 by the curved dashed lines. In an alternate form and instead of the butterfly valve 11, a pressure box may be provided. The pressure box therefor opens periodically when a certain overpressure is reached and thus provides for modulation of the gas flow. In a further alternative form of the present invention, several ventilation and suction units are provided and are suitably synchronized to produce a desired frequency of pulses which propagate in the tunnel kiln at the speed of sound. The pulses, of course, propagate in the direction of gas flow and countercurrently to the direction of the movement of the firing ware through the kiln 1.

A further alternative for modulating the gas flow includes altering the cross-section of flow of the gas. For example, the ventilation unit 9 comprises a fan with a constant output and a shutter device positioned in the air passage downstream of the fan to modify the cross-section of flow. It is also possible to vary the cross-section of flow within the tunnel kiln by means of corresponding installations. In the same way, the output of the suction unit (6) can be altered by modifying the suction cross-section, e.g., a periodically pivoted butterfly valve or shutter can be disposed upstream of suction unit 6.

Figure 1A:
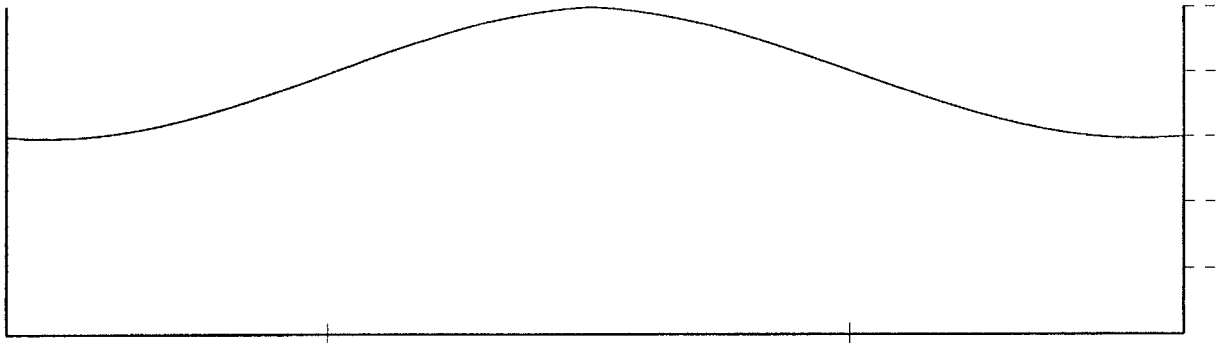
FIG. 1A is a graph illustrating the heat transmission to the firing ware in the preheating zone A, the firing zone B and the cooling zone C of prior art kilns.
Figure 1B:
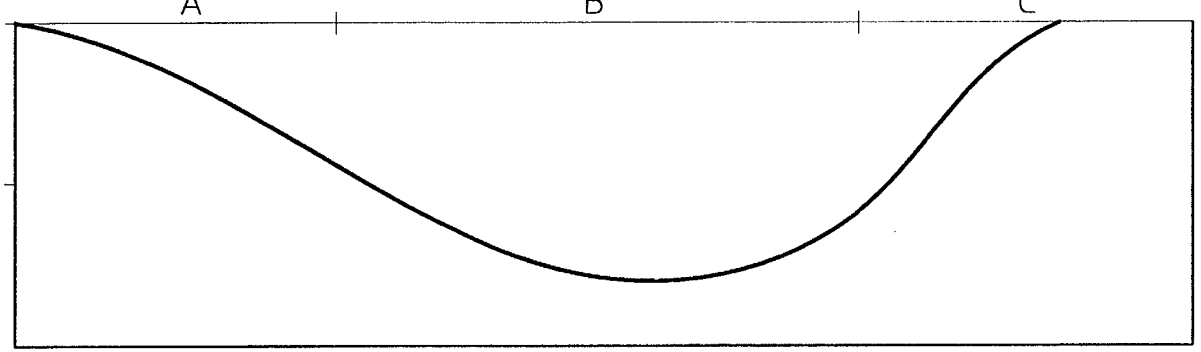
FIG. 1B is a graph illustrating the share of radiation and the share of convection respectively in the heat transmission from FIG. 1A.
Figure 4:
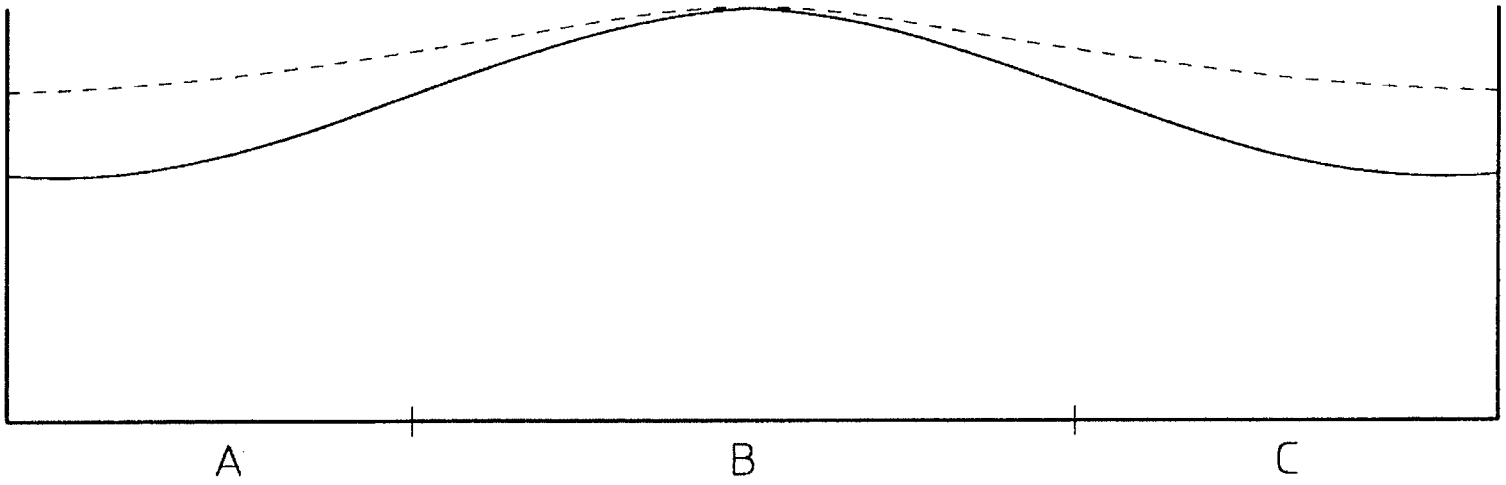
FIG. 4 is a graph illustrating the increase in heat transmission according to the present invention.

FIG. 4 shows in diagram form the heat transmission or transfer, corresponding to FIG. 1A, to the firing ware in the preheating zone A, the firing zone B and the cooling zone C in a conventional tunnel kiln (continuous line) and a tunnel kiln according to the present invention (dotted line). From FIG. 1A, it will be appreciated that in the area of the preheating zone and the cooling zone, in which according to FIG. 1B the convection heat transmission is greatest, the heat transmission according to the present invention increases most strongly. As a result, a more even or uniform distribution of the heat transfer is achieved along the entire kiln as illustrated by the dashed line in FIG. 4.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for firing products in a kiln comprising the steps of: passing the firing ware in succession through a preheating zone, a firing zone having burners and a cooling zone in the kiln;

flowing gas in a direction opposite to the direction of passage of the firing ware through the kiln, the gas flowing successively through from the cooling zone, the firing zone and the preheating zone; and pulse-modulating the flow of gas at least in the area of the preheating zone or in the area of the cooling zone.

2. A method according to claim 1 including pulse-modulating the flow of gas in said preheating zone and said cooling zone.

3. A tunnel kiln for firing ware comprising:

a preheating zone, a firing zone having burners and a cooling zone, at least one ventilation unit for said cooling zone and at least one suction unit for said preheating zone for maintaining a gas flow in the kiln in a direction opposite to the direction of the passage of the firing ware through the kiln and in succession through said cooling zone, said firing zone and said preheating zone, and a pulse-modulating unit forming part of at least one of said ventilation unit and said suction unit for pulsing the flow of gas.

4. A tunnel kiln according to claim 3 wherein said ventilation unit has a fan and means in the flow path of said fan providing for the controlled rhythmic alteration of the cross-section of flow.

5. A tunnel kiln according to claim 4 wherein said alteration means is provided within the tunnel kiln.

6. A tunnel kiln according to claim 3 wherein said ventilation unit has a fan and a speed-controlled butterfly valve positioned in the flow path of said fan for changing the ventilation capacity.

7. A tunnel kiln according to claim 3 including a pulse-modulating unit forming part of said suction unit for pulsing the gas flow.

8. A tunnel kiln according to claim 7 wherein said suction unit has a changeable suction cross-section.

9. A tunnel kiln according to claim 3 wherein at least one of the burners in the firing zone generates a pulsating gas flow.

10. A tunnel kiln according to claim 3 wherein said burners are high-velocity burners.

11. A method for firing products in a kiln comprising the steps of:

passing the firing ware in succession through a preheating zone, a firing zone having burners and a cooling zone in the kiln;

flowing gas in a direction opposite to the direction of passage of the firing ware through the kiln from the cooling zone to the preheating zone;

pulse-modulating the flow of gas at least in the area of the preheating zone or in the area of the cooling zone; and modulating the gas flow at such a frequency that the kiln gas is set into self-vibration.

* * * * *